US006896448B1

(12) United States Patent
White

(10) Patent No.: US 6,896,448 B1
(45) **Date of Patent: *May 24, 2005**

(54) AUTOMATICALLY ADJUSTABLE CAISSON CLAMP

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/716,918

(22) Filed: Nov. 18, 2003

Related U.S. Application Data

(63) Continuation-in-part of application No. 10/352,760, filed on Jan. 27, 2003, now Pat. No. 6,648,556, which is a continuation of application No. 09/921,106, filed on Aug. 1, 2001, now abandoned.

(60) Provisional application No. 60/222,347, filed on Aug. 1, 2000.

(51) Int. Cl.[7] ..... B25B 1/02; E21B 1/02

(52) U.S. Cl. ..... 405/249; 269/153; 175/171

(58) Field of Search ..... 405/198, 223, 405/232, 245, 249, 303; 173/49; 175/90, 175/203, 171, 189; 269/140–145, 152, 153

(56) References Cited

U.S. PATENT DOCUMENTS

| | | | | |
|---|---|---|---|---|
| 628,962 | A | 7/1899 | Speer | 173/124 |
| 3,172,485 | A | 3/1965 | Spannhake et al. | 173/147 |
| 3,391,435 | A | 7/1968 | Lebelle | 24/463 |
| 3,734,209 | A | 5/1973 | Haisch et al. | 175/57 |
| 3,871,617 | A | 3/1975 | Majima | 254/29 R |
| 5,076,090 | A | 12/1991 | Cetnarowski | 72/407 |
| 5,117,925 | A | 6/1992 | White | 173/162.1 |
| 5,213,449 | A | 5/1993 | Morris | 405/232 |
| 5,263,544 | A | 11/1993 | White | 173/162.1 |
| 5,355,964 | A | 10/1994 | White | 173/1 |
| 5,544,979 | A | 8/1996 | White | 405/232 |
| 5,609,380 | A | 3/1997 | White | 294/104 |
| 5,653,556 | A | 8/1997 | White | 405/249 |
| 5,794,716 | A | 8/1998 | White | 173/189 |
| 6,039,508 | A | 3/2000 | White | 405/232 |
| 6,216,394 | B1 | 4/2001 | Fenelon | 49/39 |

*Primary Examiner*—Robert E. Pezzuto
*Assistant Examiner*—Tara L. Mayo
(74) *Attorney, Agent, or Firm*—Michael R. Schacht; Schacht Law Office, Inc.

(57) ABSTRACT

A clamp system for allowing a pile driving/pulling system to be attached to a caisson to be driven into or extracted from the earth. The clamp system comprises a structural member, first and second clamp systems, first and second locking systems, and a clamp displacement system. The clamp displacement assembly is operatively connected between the structural member and the first and second clamp assembly. When the first and second clamp systems are disengaged from the pile and the first and second locking systems are disengaged from the structural member, the clamp displacement system may be operated to obtain a desired clamp distance between the first and second clamp assemblies.

17 Claims, 6 Drawing Sheets

3
82
46
B
52
22
40
72
44
90
A
70
70
56
50
74
42
9
9
72
3
84

B
46
22
40
50
94
82
54
88
44
74
90
A
80
92
86
42
74
84
96
52

22
40
5
5
72
72
70
70
44
42
82
74

22
74
88
44
40
82
80
84
50
42
74
86
54
52

AUTOMATICALLY ADJUSTABLE CAISSON CLAMP

RELATED APPLICATIONS

This is a continuation-in-part of U.S. Ser. No. 10/352,760 filed Jan. 27, 2003 now U.S. Pat. No. 6,648,556, which is a continuation of U.S. Ser. No. 09/921,106 filed Aug. 1, 2001 now abandoned, which claims priority of U.S. Provisional Application Ser. No. 60/222,347, which was filed on Aug. 1, 2000.

TECHNICAL FIELD

The present invention relates to clamping assemblies for pile drivers and, more specifically, to clamping assemblies that allow vibratory pile drivers to be connected to caissons for driving caissons into the earth.

BACKGROUND OF THE INVENTION

Modern construction design often requires caissons to be driven into the earth at desired locations. In the context of the present invention, the term "caisson" will be used to refer to hollow, cylindrical members that are driven into the earth. Caissons are normally used as part of the footing for a structural element such as a building foundation or bridge pier, but the end use of the caisson is not a part of the present invention.

Pile driving systems that impart vibratory loads are highly effective at driving elongate members such as piles, caissons, and the like into the earth. The vibratory forces of such vibratory pile deriving systems must be transmitted to the member to be driven by a clamping assembly. The clamping assembly ensures that the vibratory forces in both directions are applied to the member to be driven.

In the case of caissons, the clamping assembly conventionally comprises a rigid structural member or assembly on which are mounted two or more hydraulic clamps. The hydraulic clamps are spaced from each other along the structural member to grip the upper edge of the caisson such that the vibratory loads are symmetrically applied along the centerline of the caisson.

A basic clamping assembly for relatively small-diameter caissons comprises a single structural member and two hydraulic clamps. The hydraulic clamps are movable along the structural member to allow the clamping assembly to accommodate caissons of different diameters within a range defined by the length of the structural member.

Conventionally, the hydraulic clamps are moved by hand to desired locations on the structural member and fixed. The entire assembly is then lifted to the top of the caisson and displaced such that the top edge of the caisson enters the hydraulic clamps. The clamps are then actuated to grip the caisson and the process of driving the caisson can be commenced.

The need thus exists for improved caisson clamping systems that simplify the process of attaching a vibratory device to a caisson to be driven into the earth.

RELATED ART

The following prior art references illustrate the background of the present invention.

U.S. Pat. No. 5,653,556 to White discloses a clamp system for connecting caissons to a vibratory driver/extractor. The clamp system employs a beam assembly that supports four clamps at locations angularly spaced about the circumference of the caisson.

U.S. Pat. No. 5,544,979 to White discloses a clamp system for connecting caissons or piles to a vibratory pile driver/extractor in which the clamp engages a side surface rather than an upper end of the caisson or pile.

U.S. Pat. Nos. 5,117,925 and 5,263,544 to White disclose shock absorbing systems for use with a vibratory pile driver/extractor. These shock absorbing systems could be used with the clamp systems and methods of the present invention.

U.S. Pat. No. 5,609,380 to White discloses a clamp assembly for connecting a vibratory pile/extractor to a pile. Clamping forces are applied to the sides of the pile.

SUMMARY OF THE INVENTION

The present invention is a clamp system for allowing a pile driving/pulling system to be attached to a caisson to be driven into or extracted from the earth. The clamp system comprises a structural member, first and second clamp systems, first and second locking systems, and a clamp displacement system. The clamp displacement assembly is operatively connected between the structural member and the first and second clamp assembly. When the first and second clamp systems are disengaged from the pile and the first and second locking systems are disengaged from the structural member, the clamp displacement system may be operated to obtain a desired clamp distance between the first and second clamp assemblies.

Other features and aspects of the present invention will become apparent from the following detailed description of the invention.

DETAILED DESCRIPTION OF THE INVENTION

Figure 1:
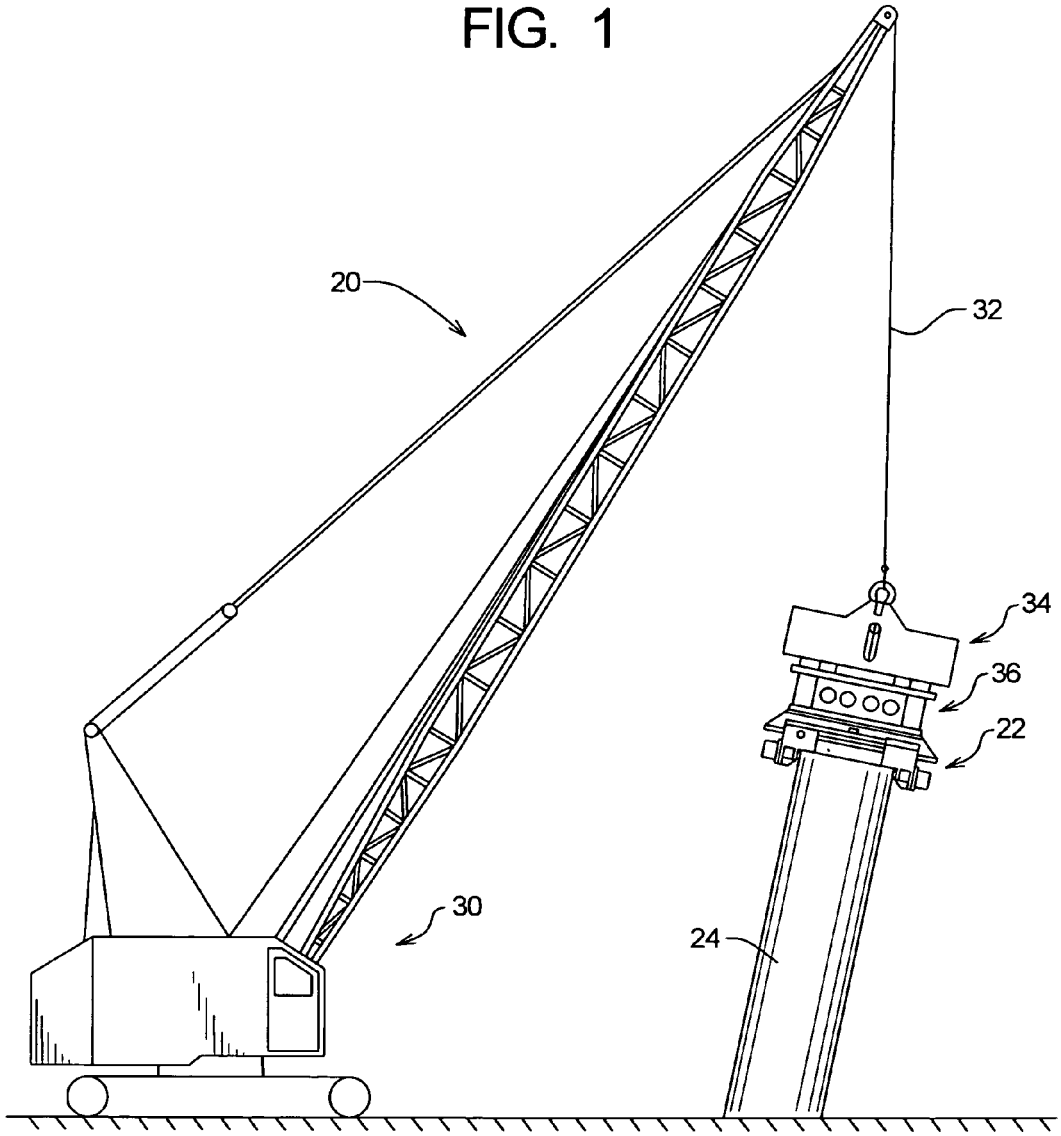
FIG. 1 is a side elevation view depicting a caisson driving system employing a clamp assembly constructed in accordance with the present invention being used to drive a caisson.
Figure 2:
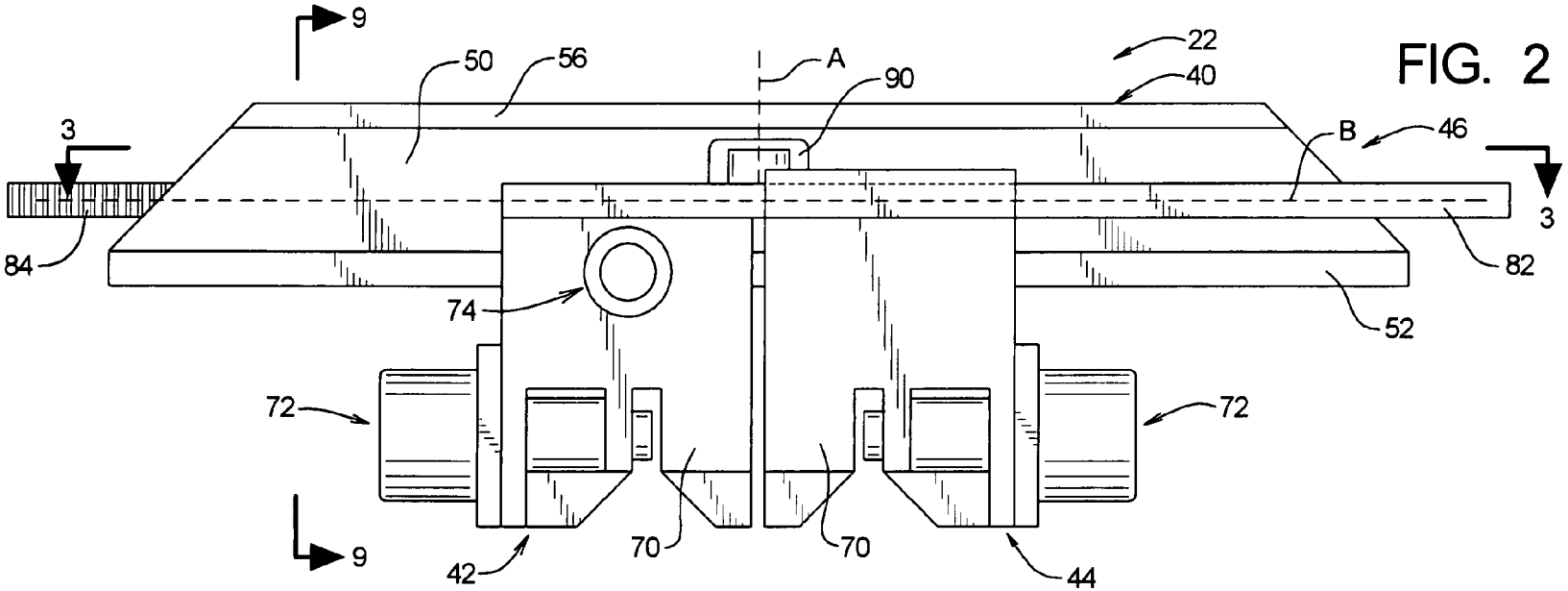
FIG. 2 is a front elevation view of the clamping assembly depicted in FIG. 1 in a first configuration.
Figure 3:
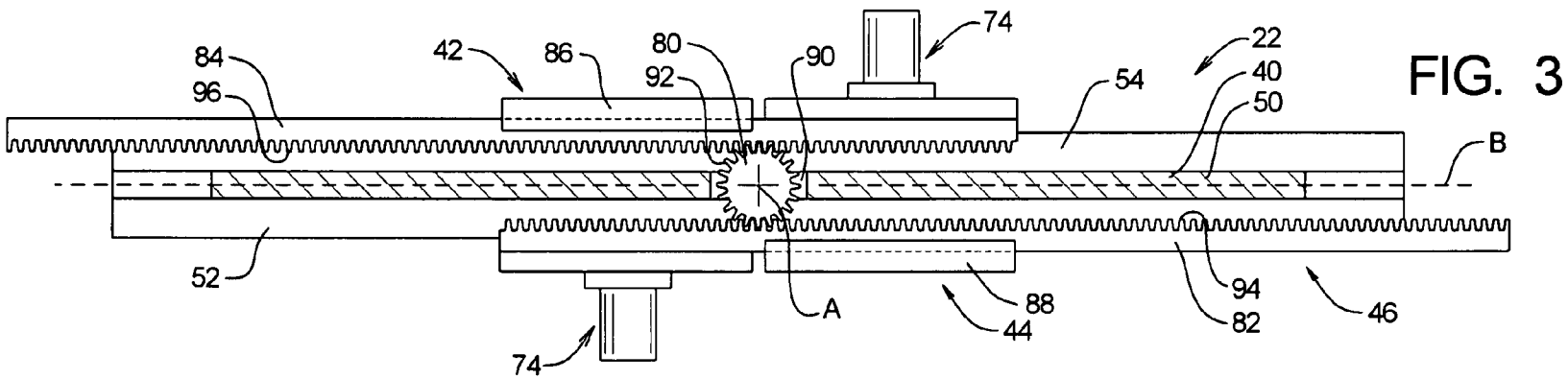
FIG. 3 is a top plan view of the clamping assembly of FIG. 1 taken along lines 3—3 in FIG. 2.
Figure 4:
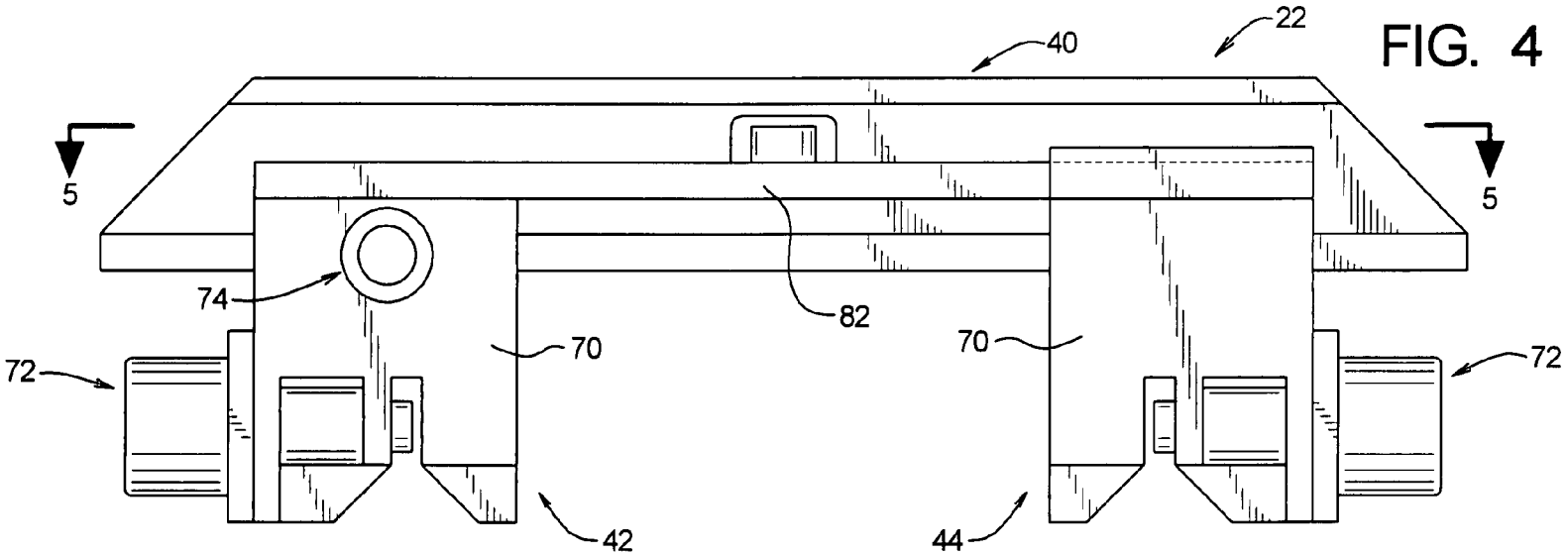
FIG. 4 is a front elevation view of the clamping assembly depicted in FIG. 1 in a second configuration.
Figure 5:
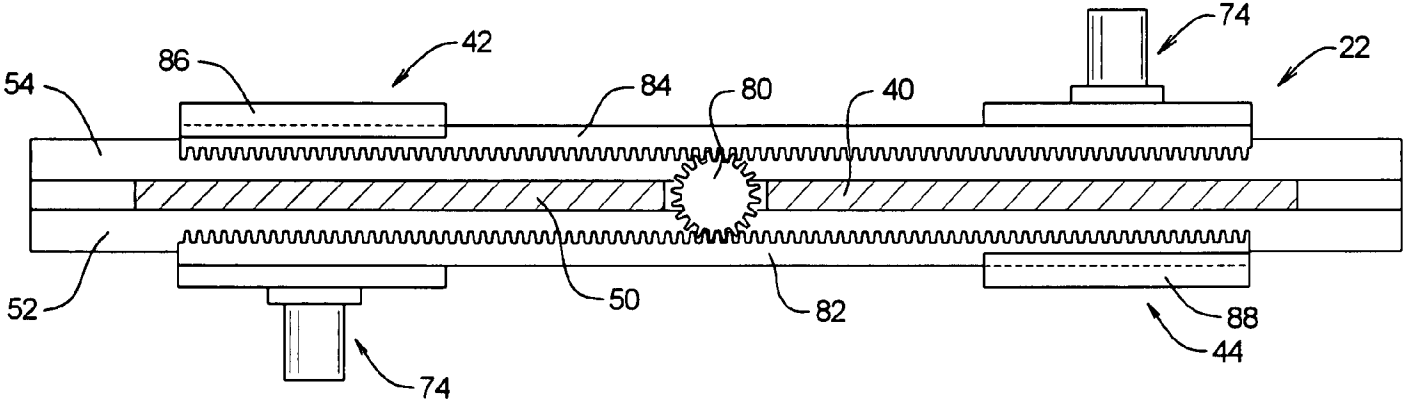
FIG. 5 is a top plan view of the clamping assembly of FIG. 1 taken along lines 5—5 in FIG. 4.

Referring initially to FIG. 1 of the drawing, depicted therein is a caisson driving system 20 employing a clamp assembly 22 constructed in accordance with, and embodying, the principles of the present invention. The exemplary caisson driving system 20 is shown driving a caisson 24.

The caisson driving system 20 further comprises a crane 30 having a crane cable 32, a suppression assembly 34 suspended from the crane 30 by the crane cable 32, and a vibratory device 36 rigidly connected to the suppression assembly 34. The vibratory device 36 is rigidly connected to the clamp assembly 22, and the clamp assembly is detachably clamped onto the caisson 24. The caisson 24, crane 30, crane cable 32, suppression assembly 34, and vibratory device 36 all are or may be conventional and will not be described in detail herein.

Referring now to FIGS. 2–5, these figures show that the clamp assembly 22 comprises a structural member or beam 40, first and second clamps 42 and 44, and a clamp displacement system 46.

Figure 9:
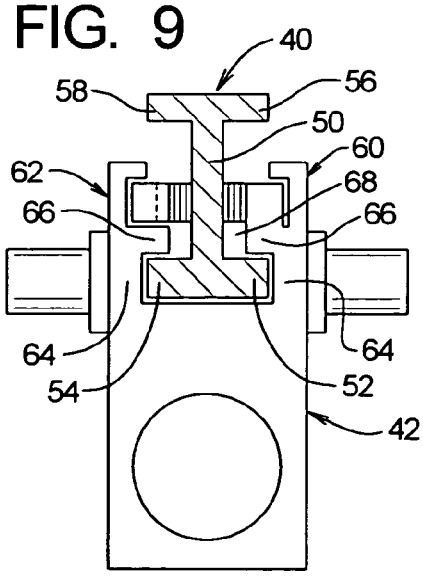
FIG. 9 is an end elevation section view taken along lines 9—9 in FIG. 2.

The structural member 40 has a central portion 50 and first and second rail projections 52 and 54 laterally extending from the center portion 50. As shown in FIG. 9, the structural member 40 further comprises first and second upper projections 56 and 58 extending from the central portion 50. In the exemplary clamping assembly 20, the first and second rail projections 52 and 54 are co-planar, the first and second upper projections 56 and 58 are co-planar and parallel to the first and second rail projections 52 and 54, and all of these projections are perpendicular to the central portion 50; the exemplary structural member 40 is thus an I-beam.

As perhaps best shown in FIG. 9, the clamps 42 and 44 each comprise first and second rail brackets 60 and 62 each having upward extending portions 64 and inwardly extending portions 66. The inwardly extending portions 66 define a slot 68 that receives the center portion 50 of the structural member 40; however, the slot 68 is narrower than the combined dimensions of the rail projections 52 and 54. The rail brackets 60 and 62 thus engage the rail projections 52 and 54 such that, during normal operation, the clamps 42 and 44 may move horizontally along the structural member 40 but may not move down relative to the structural member 40.

As perhaps best shown in FIGS. 2–5, the clamps 42 and 44 each further comprise a main housing 70, a hydraulic clamping system 72, and a hydraulic locking system 74. The hydraulic clamping system 72 and locking systems 74 are mounted to the main housing. These systems 72 and 74 are or may be conventional and will not be described herein beyond the extent necessary for a complete understanding of the present invention.

The clamping system 72 engages the upper edge of the caisson 24 selectively to fix the caisson 24 relative to the clamps 42 and 44 through the clamp housings 70. The locking system 74 engages the structural member 40 selectively to prevent relative movement between the clamps 42 and 44 and the structural member 40. As generally discussed above, the clamping systems 72 and locking systems 74 each comprise a physical assembly corresponding to the structure identified by reference characters 42 and 44 in the drawing. As will be discussed in further detail below, these systems 72 and 74 further comprise a hydraulic portion that operates the physical assembly in a known manner to obtain the result described herein.

The clamping system 72 and locking system 74 are thus both actuated to fix the position of the caisson 24 relative to the structural member 40; both the clamping system 72 and the clocking system 74 will be actuated during driving of the caisson 24. During adjustment of the positions of the clamps 42 and 44 (as will be described in further detail below), the clamps 42 and 44 will be disengaged from the caisson 24 (with the clamping systems 72 de-actuated), and the locking systems 74 must be de-actuated.

The exemplary clamp displacement system 46 comprises a drive pinion 80, first and second rack members 82 and 84, and first and second guide members 86 and 88. In the exemplary clamp assembly 22, the drive pinion 80 is mounted in an opening 90 in the structural member 40 such that its axis of rotation A is vertical and extends substantially through the center of gravity of the structural member 40.

The drive pinion 80 comprises drive teeth 92, and the rack members 82 and 84 comprise rack teeth 94 and 96 sized and dimensioned to engage the drive teeth 92.

The first rack member 82 is rigidly connected to the first clamp 42, and the second rack member 84 is rigidly connected to the second clamp 44. In particular, in the exemplary clamp assembly 22, when the racks 82 and 84 are attached to the clamps 42 and 44 and the clamps 42 and 44 are supported by the structural member 40 as described above, the racks 82 and 84 extend from their associated clamps in opposite directions on opposite sides of the structural member 40. In addition, the racks 82 and 84 are spaced on either side of the central portion 50 of the structural member 40 such that the rack teeth 94 and 96 engage the drive teeth 92.

The second guide member 88 is rigidly connected to the first clamp 42, and the first guide member 86 is rigidly connected to the second clamp 44. In addition, the first guide member 86 is arranged on an opposing side of the structural member central portion 50 from the first rack member 82, and the second guide member 88 is arranged on an opposing side of the central portion 50 from the second rack member 84.

When the clamps 42 and 44 are supported by the structural member 40 as described above, the first and second guide members 86 and 88 receive the second and first rack members 84 and 82, respectively.

The guide members 86 and 88 support the rack members 82 and 84 such that these members 82 and 84 stay parallel to each other during normal operation. In particular, when the vibratory device is operating, forces are generated that will tend to rotate the rack members 82 and 84 in a vertical are centered at the point where the rack members 82 and 84 are attached to the clamps 42 and 44. The guide members 86 and 88 limit this rotational movement of the rack members 82 and 84 relative to the clamps 42 and 44 and thus reduce fatigue and wear on the rack members 82 and 84.

The exemplary clamping system 72, locking system 74, and drive pinion 76 are all operated by pressurized hydraulic fluid. The clamping system 72 and locking system 74 comprise a hydraulic piston assembly that displaces a clamp member when pressurized hydraulic fluid is applied to the piston, while the drive pinion 76 comprises a hydraulic motor that creates rotational motion from pressurized hydraulic fluid. For simplicity and clarity, the source of the pressurized hydraulic fluid is not shown in the drawings, but is or may be conventional.

The operation of the clamping system 72, locking system 74, and drive pinion 76 may be remotely controlled, for example by an operator of the crane 30, by controlling the flow of pressurized hydraulic fluid from the source. The design of the fluid control circuitry required to allow the operator to control the clamping and locking systems 72 and 74 and drive pinion 76 is conventional, would be apparent to one of ordinary skill in the art, and will not be described in detail herein.

The clamp assembly 22 is operated in the following general manner. Initially, the clamping systems 72 and locking systems 74 are de-actuated. The operator then determines the size, or diameter, of the first caisson to be driven and operates the drive pinion 80 to displace the racks 82 and 84, and thus the clamps 42 and 44, along a longitudinal axis B of the structural member 40. When the effective locations of the clamps 42 and 44 are spaced from each other a distance approximately equaling the diameter of the first caisson to be driven, the drive pinion 80 is stopped. The entire clamp assembly 22 is then displaced until the clamps 42 and 44 receive opposing edge portions of the first caisson to be driven. The drive pinion 80 will engage the racks 82 and 84 to inhibit incidental movement of the clamps 42 and 44 during maneuvering of the clamp assembly 22.

When the caisson edges are received by the clamps 42 and 44, the clamping systems 72 are actuated to fix the caisson relative to the clamp housings 70. The locking systems 74 are then actuated to fix the clamp housings 70 relative to the structural member 40. The caisson driving system 20 may then be used to drive the first caisson.

If the remaining caissons to be driven are the same diameter as the first caisson, the clamping systems 72 are de-actuated, the clamp assembly 22 is maneuvered such that the clamps 42 and 44 receive the upper opposing edge portions of the next caisson, and the clamping systems 72 are actuated to fix the position of the new caissons relative to the clamp housings 70. The caisson driving system 20 may than be used to drive the new caisson.

If the next caisson to be driven has a different diameter as the first caisson, the process described above for the first caisson is repeated. The present invention is thus of particular importance in situations where caissons of different diameters are to be driven. For example, a design may call for caissons of a first diameter to be alternated with caissons of a second diameter. The present invention greatly reduces the overall time to drive all of the caissons because the process of reconfiguring the clamp assembly 22 for the different caisson diameters is significantly quicker.

Figure 6:
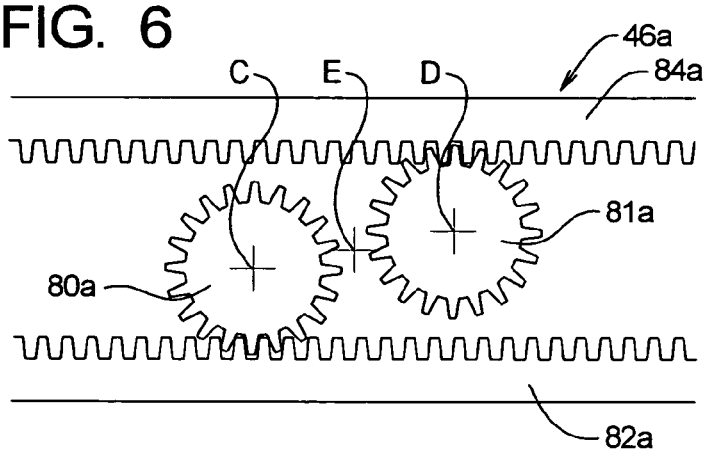
FIG. 6 is a somewhat schematic, top plan view of a first alternate clamp displacement system that may be used by the clamping assembly of FIG. 1.

Referring now to FIG. 6, schematically depicted therein is an alternate clamp displacement system 46*a* that may be substituted for the clamp displacement system 46 described above. This displacement system 46*a* is similar to the system 46 and will be described only to the extent that it differs from the system 46.

The system 46*a* comprises first and second drive pinions 80*a* and 81*a* associated with the racks 82*a* and 84*a*, respectively. The axes of rotation C and D of the exemplary drive pinions 80*a* and 81*a* are symmetrically arranged relative to a vertical axis E extending through the center of gravity of the clamp assembly 22. The use of two drive pinions 80*a* and 81*a* allows the racks 82*a* and 84*a*, and thus the clamps 42 and 44 attached thereto, to be independently moved along the structural member 40.

Figure 7:
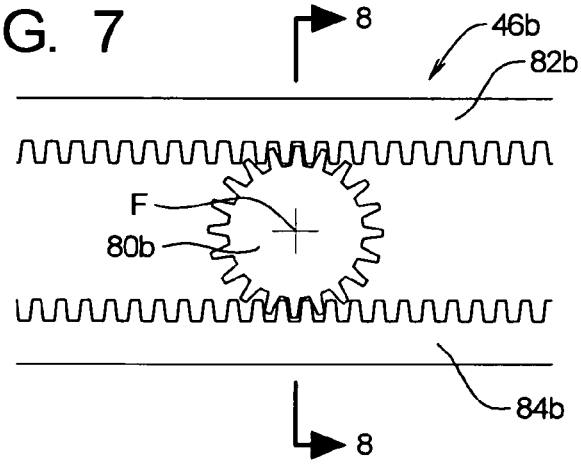
FIG. 7 is a somewhat schematic, top plan view of a second alternate clamp displacement system that may be used by the clamping assembly of FIG. 1.
Figure 8:
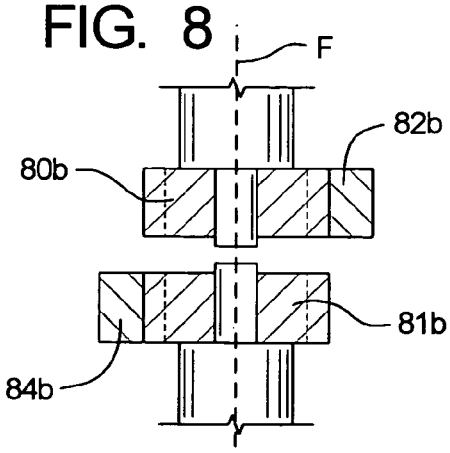
FIG. 8 is a somewhat schematic, front elevation, partial cutaway view of the clamp displacement system of FIG. 7.

Referring now to FIGS. 7 and 8, schematically depicted therein is an alternate clamp displacement system 46*b* that may also be substituted for the clamp displacement system 46 described above. This displacement system 46*b* is similar to the system 46*a* and will be described only to the extent that it differs from the system 46*a*.

The system 46*b* also comprises first and second drive pinions 80*b* and 81*b* associated with the racks 82*a* and 84*a*, respectively. However, the drive pinions 80*b* and 81*b* are stacked such that the axes of rotation of the exemplary drive pinions 80*a* and 81*a* are symmetrically arranged relative to a vertical axis F extending through the center of gravity of the clamp assembly 22. Like the displacement system 46*a*, the system 46*b* employs two drive pinions 80*b* and 81*b* that allow the racks 82*b* and 84*b*, and thus the clamps 42 and 44 attached thereto, to be independently moved along the structural member 40.

One variation on the system disclosed in FIGS. 7 and 8 is to arrange both of the racks 82*b* and 84*b* on the same side of the structural member 40. Another variation is to align the racks 82*b* and 84*b* with the longitudinal axis of the structural member 40, in which case the drive pinions 80*b* and 81*b* will be spaced (preferably but not necessarily on opposite sides) from the vertical axis F extending through the center of gravity of the assembly 22.

Referring now to FIGS. 10–13, depicted therein is a clamp displacement system 46*c* that may be substituted for the clamp displacement system 46 described above. This displacement system 46*c* is similar to the system 46 and will be described only to the extent that it differs from the system 46.

The clamp displacement system 46*c* comprises a drive gear 120, a drive chain 122, a first drive cable 124, a second drive cable 126, and a guide roller 128. A first coupler 130 connects a first end of the drive chain 122 to the first clamp assembly 42. A second coupler 132 connects a second end of the drive chain 122 to a first end of the first drive cable 124. A third coupler 134 connects a second end of the first drive cable 124 to the second clamp assembly 44 on a first side of the structural member 40*c*. A fourth coupler 136 connects a first end of the second drive cable 126 to the second clamp assembly 44. A fifth coupler 138 connects a second end of the second drive cable 126 to the first clamp assembly 42 on a second side of the structural member 40*c*.

Figure 10:
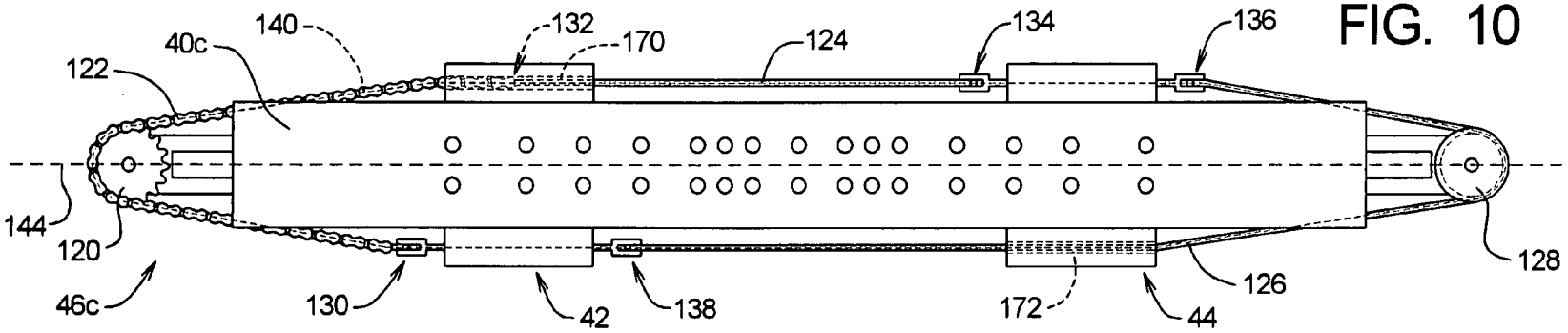
FIG. 10 is a top plan view of a clamp displacement system of a third alternate clamp displacement system that may be used by the clamping assembly of FIG. 1.

The drive chain 122 and first and second drive cables define a closed drive path 140 illustrated by dotted lines in FIG. 10. The guide roller 128 engages the second drive cable 136 and the drive gear 120 engages the drive chain 122 such that the drive chain 122 and drive cables 124 and 126 are held in a drive plane 142 shown by dotted lines in FIG. 142. The drive plane 142 is defined by the drive path 140.

In addition, the drive chain 122 engages the drive gear 120 such that rotation of the drive gear 120 displaces the drive chain 122 along the drive path 140. The connections formed by the couplers 130–138 described above ensure that, as the drive chain moves along the drive path 140, the first and second drive cables 124 and 126 are also displaced along the drive path 140. These connections further displace the clamp assemblies 42 and 44 in the same direction along the drive path 140. However, because the drive path 140 is a closed loop that extends along both sides of the structural member 40*c*, the clamp assemblies 42 and 44 move in opposite directions along a structural axis 144 (FIG. 10) defined by a structural member 40*c*.

Figure 12:
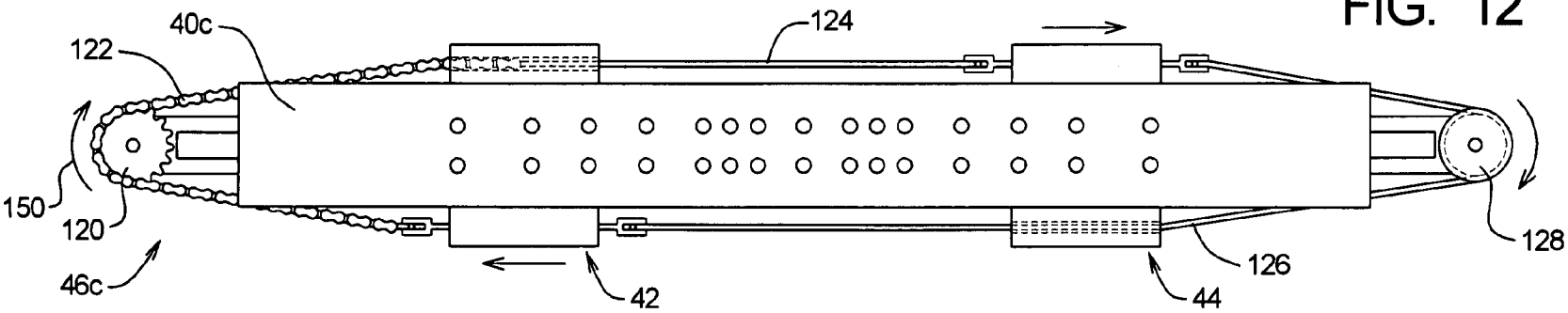
FIGS. 12 and 13 are top plan views depicting the operation of the clamp displacement system of FIG. 10.
Figure 13:
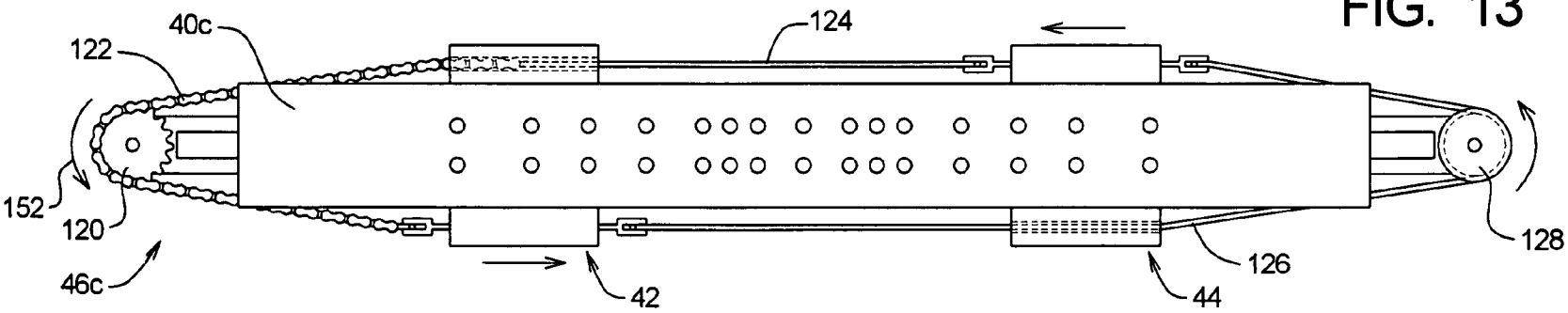

In particular, FIG. 12 illustrates that, when the drive gear 122 rotates in a first direction 150, the clamp assemblies 42 and 44 move away from each other along the structural axis 144. FIG. 13 illustrates that, when the drive gear 122 rotates in a second direction 152, the clamp assemblies 42 and 44 move towards each other along the structural axis 144. The clamp displacement system 46*c* thus may be used in a manner similar to the system 46 described above to allow different caisson diameters to be quickly and easily accommodated.

The example structural member 40*c* is an I-beam having a lower flange 160, an intermediate portion 162, and an upper flange 164. The lower flange 160 extends beyond the intermediate portion 162 on each end of the structural member 40*c* to form first and second mounting surfaces 166 and 168 on which the drive gear 122 and guide roller 128, respectively, are mounted. Other structures may be used to support the drive gear 122 and guide roller 128 within the scope of the present invention, however.

In the example clamp displacement system 46*c*, first and second guide passageways 170 and 172 (FIGS. 10 and 11) are formed in the first and second clamp assemblies 42 and 44, respectively. The drive chain 122 and/or first drive cable 124 extend through the first guide passageway 170. The second drive cable 126 extends through the second guide passageway 172. The guide passageways 170 and 172 are bores that support the drive chain 122 and first and second drive cables 124 and 126 for movement along the drive path 140.

While the example passageways 170 and 172 are illustrated as bores formed in the housings of the clamp assemblies 42 and 44, the passageways 170 and 172 may also be formed by grooves are notches formed in or by the clamp assemblies 42 and 44. The guide passageways 170 and 172 may be omitted but help stabilize the flexible drive chain 122 and drive cables 124 and 126 when the system 46*c* is vibrated.

While the example clamp displacement system 46*c* employs first and second drive cables 124 and 126, the function of these cables 124 and 126 may be formed by a single cable that is fastened to the second clamp assembly 44.

In addition, the drive cables 124 and 126 may be omitted entirely and replaced by a longer drive chain 122 that extends along the drive path 140. In this case, the drive chain 122 may be a continuous chain extending along the entire drive path 140 and secured at appropriate locations to the first and second clamp assemblies 42 and 44. Alternatively, the drive chain 122 may be secured at a first end to a first side of the first clamp assembly 42, at an intermediate point to the second clamp assembly 44, and at a second end to a second side of the second clamp assembly 42.

Additionally, if a single drive chain is used, the guide roller 128 would be replaced by a driven or non-driven gear that helps support the single drive chain along the drive path 140.

Figure 11:
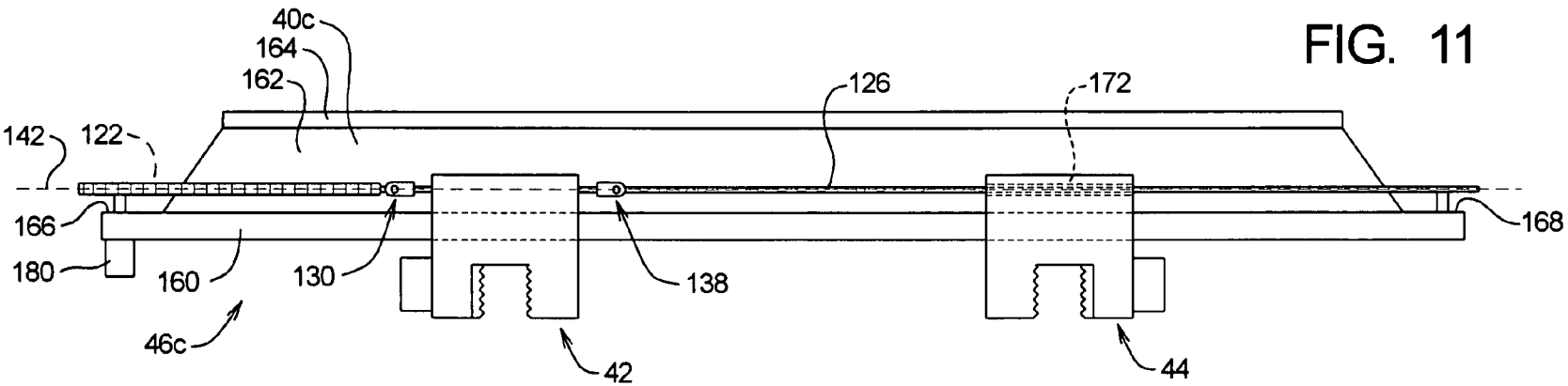
FIG. 11 is side elevation view of the clamp displacement system of FIG. 10.

FIG. 11 further depicts an example drive motor 180 for rotating the drive gear 122. The example drive motor 180 is a hydraulic motor, but the drive motor 180 may be any device cable of generating sufficient power to displace the clamp assemblies 42 and 44 as described above.

In any of the embodiments described above, the present invention is preferably embodied as a clamp assembly 22 that is substantially symmetrical about a vertical axis extending through the center gravity of the clamp assembly 22. Such symmetry helps ensure that the vibratory forces generated by the vibratory device 36 and transmitted to the caisson 24 are applied along the longitudinal axis of the caisson 24.

However, in some situations, it may be possible to obtain a satisfactory clamp assembly according to the present invention that is not completely symmetrical. For example, one of the two clamp assemblies may be fixed and the other adjustable as described above; this arrangement would require only one drive pinion and rack and thus would be simpler to manufacture at the expense of loss of symmetry.

In addition, while as few as one clamp may be moved or adjusted with a drive pinion and rack as described above, three, four, or more clamps may be moved in accordance with the present invention in its broadest form. For example, three clamps may be provided on a structural member adapted to arrange the clamps at 120° increments about the circumference of the caisson. In this case, the racks and associated drive pinions would most efficiently be arranged at different horizontal levels so that they do not interfere with each other.

In another example, four clamps may be provided on a structural member adapted to arrange the clamps at 90° increments about the caisson circumference. Such a structural member would comprise two cross-arms that intersect at a central location. A likely arrangement for the racks and pinions would be a lower set on either side of one cross-arm and an upper set on either side of the other cross-arm.

From the foregoing, it should be clear that the present invention may be embodied in forms other than those described above. The above-described systems are therefore to be considered in all respects illustrative and not restrictive.

What is claimed is:

1. A clamp system for allowing a pile driving/pulling system to be attached to a caisson to be driven into or extracted from the earth, comprising:

a structural member adapted to be attached to the pile driving/pulling system;

first and second clamp systems comprising first and second clamp assemblies, respectively, where the first and second clamp systems are supported by the structural member and operate in a first clamp mode in which the clamp assemblies are adapted to selectively clamp onto portions of the caisson, and a second clamp mode in which the clamp assemblies are adapted to release from the caisson;

first and second locking systems each having a locking assembly mounted on the first and second clamp assemblies, respectively, where each of the first and second locking systems operate in a first lock mode in which a position of the clamp assemblies relative to the structural member is fixed, and a second lock mode in which the clamp assemblies are allowed to move relative to the structural member; and a clamp displacement system having a clamp displacement assembly that displaces the first and second clamp assemblies relative to the structural member; whereby when the first and second clamp systems are in the second clamp mode and the first and second locking systems are in the second lock mode, the clamp displacement system may be operated to displace the clamp assemblies relative to the structural member to obtain a desired clamp distance between the first and second clamp assemblies.

2. A clamp system as recited in claim 1, in which the clamp displacement assembly comprises:

a drive chain operatively connected to the first and second clamp assemblies; and a drive gear; where the drive gear engages the drive chain such that rotation of the drive gear causes movement of the first and second clamp assemblies.

3. A clamp system as recited in claim 2, in which the clamp displacement assembly further comprises a first guide cable that operatively connects the drive chain to the second clamp assembly.

4. A clamp system as recited in claim 3, in which the clamp displacement assembly further comprises a second guide cable operatively connected between the first and second clamp assemblies.

5. A clamp system as recited in claim 4, in which the clamp displacement assembly further comprises a guide roller for guiding the second guide cable.

6. A clamp system as recited in claim 5, in which:

the drive gear is located on a first end of the structural member; and the guide roller is located on a second end of the structural member.

7. A clamp system as recited in claim 4, in which:

at least one of the drive chain and the first guide cable extends through an opening in the first clamp assembly; and the second guide cable extends through an opening the second clamp assembly.

8. A clamp system as recited in claim 4, in which the drive chain, first guide cable, and second guide cable define a closed guide path such that:

rotation of the drive gear in a first direction causes the first and second clamp assemblies to move towards each other along the structural member; and rotation of the drive gear in a second direction causes the first and second clamp assemblies to move away each other along the structural member.

9. A clamp system as recited in claim 3, in which at least one of the drive chain and the first guide cable extends through an opening in the first clamp assembly.

10. A clamp system for allowing a pile driving/pulling system to be attached to a caisson to be driven into or extracted from the earth, comprising:

a structural member adapted to be attached to the pile driving/pulling system;

first and second clamp systems comprising first and second clamp assemblies, respectively, that engage the structural member such that the first and second clamp assemblies can move along the structural member, where the first and second clamp systems operate in a first clamp mode in which the clamp assemblies are adapted to selectively clamp onto portions of the caisson, and a second clamp mode in which the clamp assemblies are adapted to release from the caisson;

first and second locking systems each having a locking assembly mounted on the first and second clamp assemblies, respectively, where each of the first and second locking systems operate in a first lock mode in which a position of the clamp assemblies relative to the structural member is fixed, and a second lock mode in which the clamp assemblies are allowed to move relative to the structural member; and a clamp displacement system having a clamp displacement assembly operatively connected between the structural member and the first and second clamp assembly, the clamp displacement system comprising a drive chain operatively connected to the first and second clamp assemblies, and a drive gear; whereby the drive gear engages the drive chain such that rotation of the drive gear causes movement of the first and second clamp assemblies; and when the first and second clamp systems are in the second clamp mode and the first and second locking systems are in the second lock mode, the clamp displacement system may be operated to displace the clamp assemblies relative to each other to obtain a desired clamp distance between the first and second clamp assemblies.

11. A clamp system as recited in claim 10, in which the clamp displacement assembly further comprises a first guide cable that operatively connects the drive chain to the second clamp assembly.

12. A clamp system as recited in claim 11, in which the clamp displacement assembly further comprises a second guide cable operatively connected between the first and second clamp assemblies.

13. A clamp system as recited in claim 12, in which the clamp displacement assembly further comprises a guide roller for guiding the second guide cable.

14. A clamp system as recited in claim 13, in which:

the drive gear is located on a first end of the structural member; and the guide roller is located on a second end of the structural member.

15. A clamp system as recited in claim 12, in which:

at least one of the drive chain and the first guide cable extends through an opening in the first clamp assembly; and the second guide cable extends through an opening the second clamp assembly.

16. A clamp system as recited in claim 12, in which the drive chain, first guide cable, and second guide cable define a closed guide path such that:

rotation of the drive gear in a first direction causes the first and second clamp assemblies to move towards each other along the structural member; and rotation of the drive gear in a second direction causes the first and second clamp assemblies to move away each other along the structural member.

17. A clamp system as recited in claim 11, in which at least one of the drive chain and the first guide cable extends through an opening in the first clamp assembly.

* * * * *